US005529659A

United States Patent [19]

Ellsworth et al.

[11] Patent Number: 5,529,659

[45] Date of Patent: Jun. 25, 1996

[54] MACHINE AND ASSOCIATED APPARATUS FOR ATTACHING ZIPPERS TO PLASTIC BAGS

[75] Inventors: William D. Ellsworth, Fairport; David Z. Dike, Port Gibson; David I. Laber, Victor, all of N.Y.

[73] Assignee: Proven Designs, Inc., Palmyra, N.Y.

[21] Appl. No.: 344,866

[22] Filed: Nov. 25, 1994

[51] Int. Cl.[6] ..... B31B 1/64; B31B 1/90

[52] U.S. Cl. ..... 156/552; 156/66; 493/190; 493/206; 493/215

[58] Field of Search ..... 156/66, 522, 552, 156/583.5; 493/214, 215, 212, 213, 190, 198, 206, 209

[56] References Cited

U.S. PATENT DOCUMENTS

| | | | |
|---|---|---|---|
| 3,202,559 | 8/1965 | Laguerre | 156/66 |
| 3,426,396 | 2/1969 | Laguerre | 493/214 |
| 3,532,571 | 10/1970 | Ausnit | 493/214 |
| 3,554,822 | 1/1971 | Schwarzkopf | 156/66 |
| 3,839,128 | 10/1974 | Arai | 493/214 |
| 3,986,914 | 10/1976 | Howard | 156/66 |
| 4,094,729 | 6/1978 | Beccia | 493/214 |
| 4,964,795 | 10/1990 | Tooman | 264/40.1 |
| 5,014,497 | 5/1991 | McMahon | 493/209 |

FOREIGN PATENT DOCUMENTS

| | | | |
|---|---|---|---|
| 60-178034 | 9/1985 | Japan | 493/190 |
| 2251404 | 7/1992 | United Kingdom | 493/214 |

*Primary Examiner*—Daniel J. Stemmer
*Attorney, Agent, or Firm*—Shlesinger Fitzsimmons Shlesinger

[57] ABSTRACT

The two separable elements of a conventional plastic zipper are advanced through a zipper guide slot from the inlet to the outlet end of a machine, simultaneously with two sections of a plastic film or web, one section of which overlies one of the zipper elements, and the other section of which overlies the other zipper element. Intermittently two jaws are advanced toward the web sections to squeeze them against opposite sides of the zipper, at which time a pair of registering hot bars that are resiliently mounted on the jaws adjacent the inlet end of the machine fuse each web section to a different one of the two zipper elements. At the same time, a pair of cold bars carried by the jaws adjacent the outlet end of the machine engage and cool portions of web sections which were previously fused to the two zipper elements. Idler rolls inclined to the zipper guide slot retain the folded web tautly over opposite sides of the zipper guide slot. One side of the guide slot is formed by an elongate metal plate having an elongate stiffening bar secured to one face thereof, and having secured in spaced openings therein a plurality of aluminum plugs which prevent undue distortion of the plate in response to extreme temperature changes.

12 Claims, 6 Drawing Sheets

MACHINE AND ASSOCIATED APPARATUS FOR ATTACHING ZIPPERS TO PLASTIC BAGS

BACKGROUND OF THE INVENTION

This invention relates to the manufacture of plastic bags, and more particularly to plastic bags of the type having thereon so-called zipper elements which permit the bag to be repeatedly opened and closed by finger pressure or the like. More particularly this invention relates to an improved machine and associated apparatus for manufacturing such bags.

There are currently available in the marketplace numerous machines for manufacturing zippered plastic bags of the type described. U.S. Pat. Nos. 4,101,355 and 4,355,494, for example, disclose apparatus for producing recloseable plastic bags of the type which utilize so-called zipper fastening elements to permit repeated opening and closing of the associated bag. With these machines the zipper elements are attached by adhesive or by heat fusion to the travelling web or plastic material which is to form the bag. Also, U.S. Pat. No. 4,430,070 teaches the use of hot air for fusing or otherwise securing the cooperating zipper sections to plastic bag material, while U.S. Pat. No. 4,663,915 also discloses apparatus for attaching zipper elements to plastic bag material by use of an adhesive material (for example hot melt adhesive) or by fusion.

In each of the above-noted apparatus, extreme care must be taken to make sure that the proper amount of pressure is applied to the zipper elements as they are fastened to the plastic film or web which is to form the bag. This becomes more difficult in most cases when heat is utilized for fusing the zipper elements to the plastic bag-making film or web. The heat has a tendency to cause metal supporting elements to expand and/or contract different rates, therefore making it extremely difficult to apply uniform pressure to the zipper elements and the film, particularly over extending lengths thereof.

Also it heretofore has been customary to interpose between the heating element and the plastic materials which are to be fused together, a TEFLON element, which prevents the plastic material, when fused, from adhering to the heating element. In those machines in which the attachment of the zipper elements to the bag-making film occurs by advancing the elements and the film continuously in one direction, it has been customary to mount the intervening Teflon element in the form of an endless belt, which travels in the direction of the film and zipper elements. However, the mechanism heretofore employed for mounting such Teflon belts has been rather complicated and unsatisfactory.

It is an object of this invention, therefore, to provide an improved machine for heat fusing zipper elements to the web or film from which reclosable plastic bags are manufactured.

A more specific object of this invention is to provide for a machine of the type described apparatus which minimizes any undesirable distortion of machine parts which might otherwise result from extreme temperature differentials developed in the machine.

Other objects of the invention will be apparent hereinafter from the specification and from the recital of the appended claims, particularly when read in conjunction with the accompanying drawings.

SUMMARY OF THE INVENTION

The two sections of a plastic zipper are advanced longitudinally through a zipper guide slot in a bag making machine, and between two sections of plastic web, which intermittently are urged by a pair of jaws into engagement with the zipper to fuse each zipper section to one of the web sections. Each jaw has a hot bar for fusing a section of the web to a zipper section, and a cold bar for, cooling the fused connection. The zipper guide slot is formed between the confronting edges of a pair of spaced plates, one of which has an elongate stiffening rib secured to one side thereof, and a plurality of aluminum plugs secured therein to minimize any distortion of the plate in response to extreme temperature changes. Means retains the two zipper sections connected to each other during passage through the machine, and momentarily separates them as they leave the machine. A TEFLON containing belt, which travels in an endless path on each jaw between the plastic web and the hot and cold bars of the jaw, has one run thereof that travels longitudinally through an opening in the jaw.

THE DRAWINGS

DETAILED DESCRIPTION OF THE PREFERRED EMBODIMENTS

Figure 1:
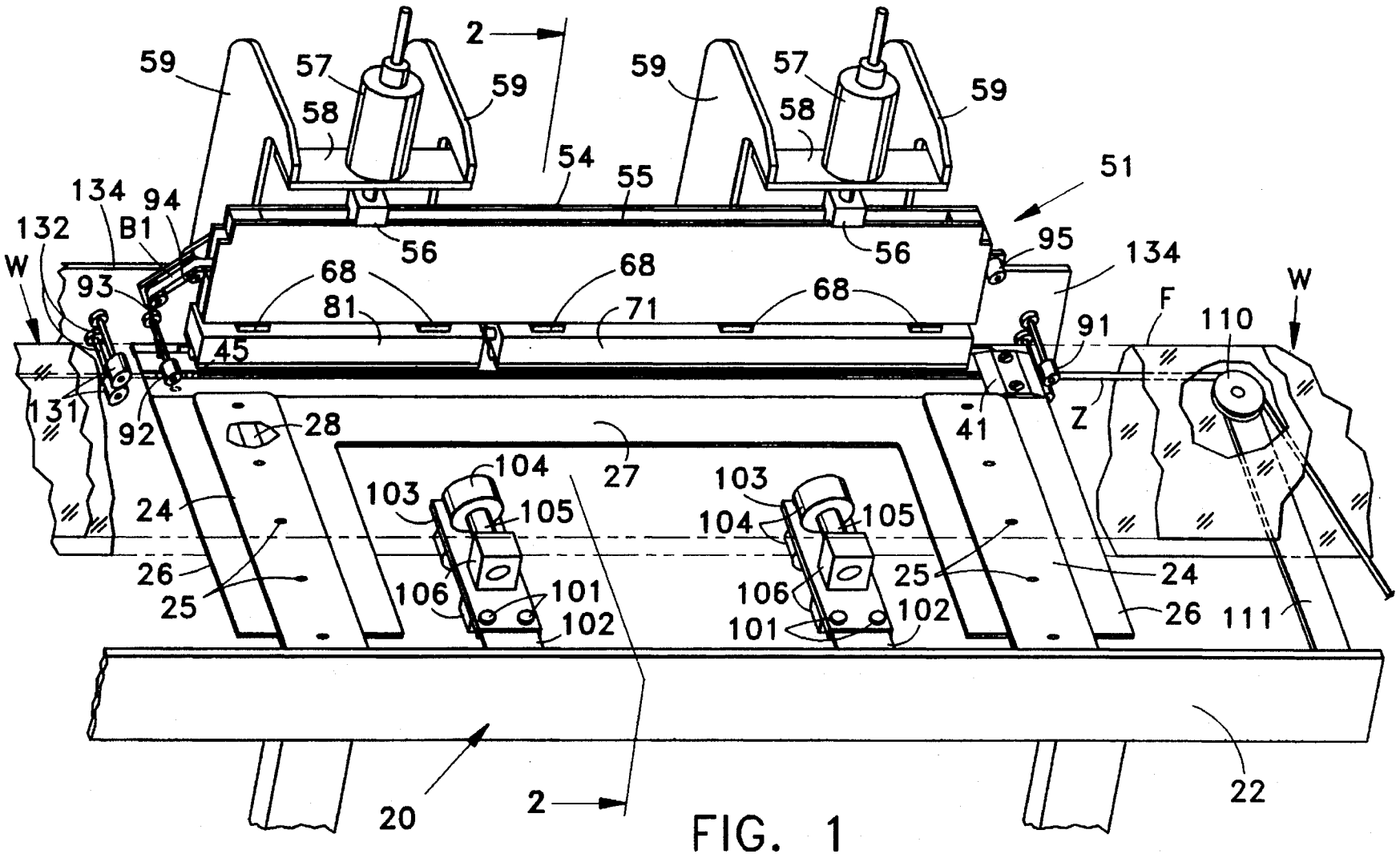
FIG. 1 is a fragmentary perspective view of a machine made according to one embodiment of this invention for attaching zippers to plastic bags.
Figure 2:
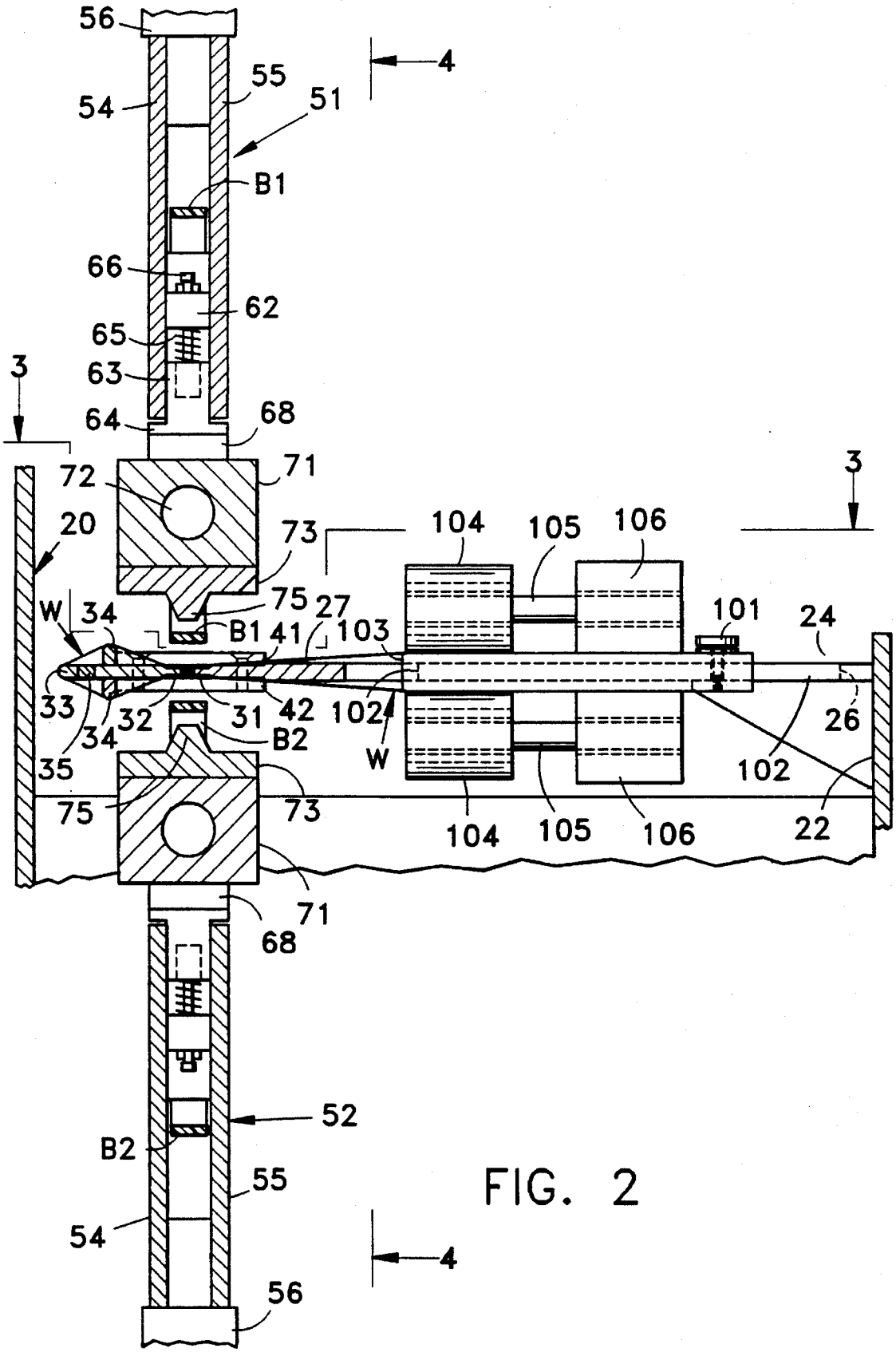
FIG. 2 is an enlarged, fragmentary sectional view taken generally along the line 2—2 in FIG. 1 looking in the direction of the arrows.
Figure 3:
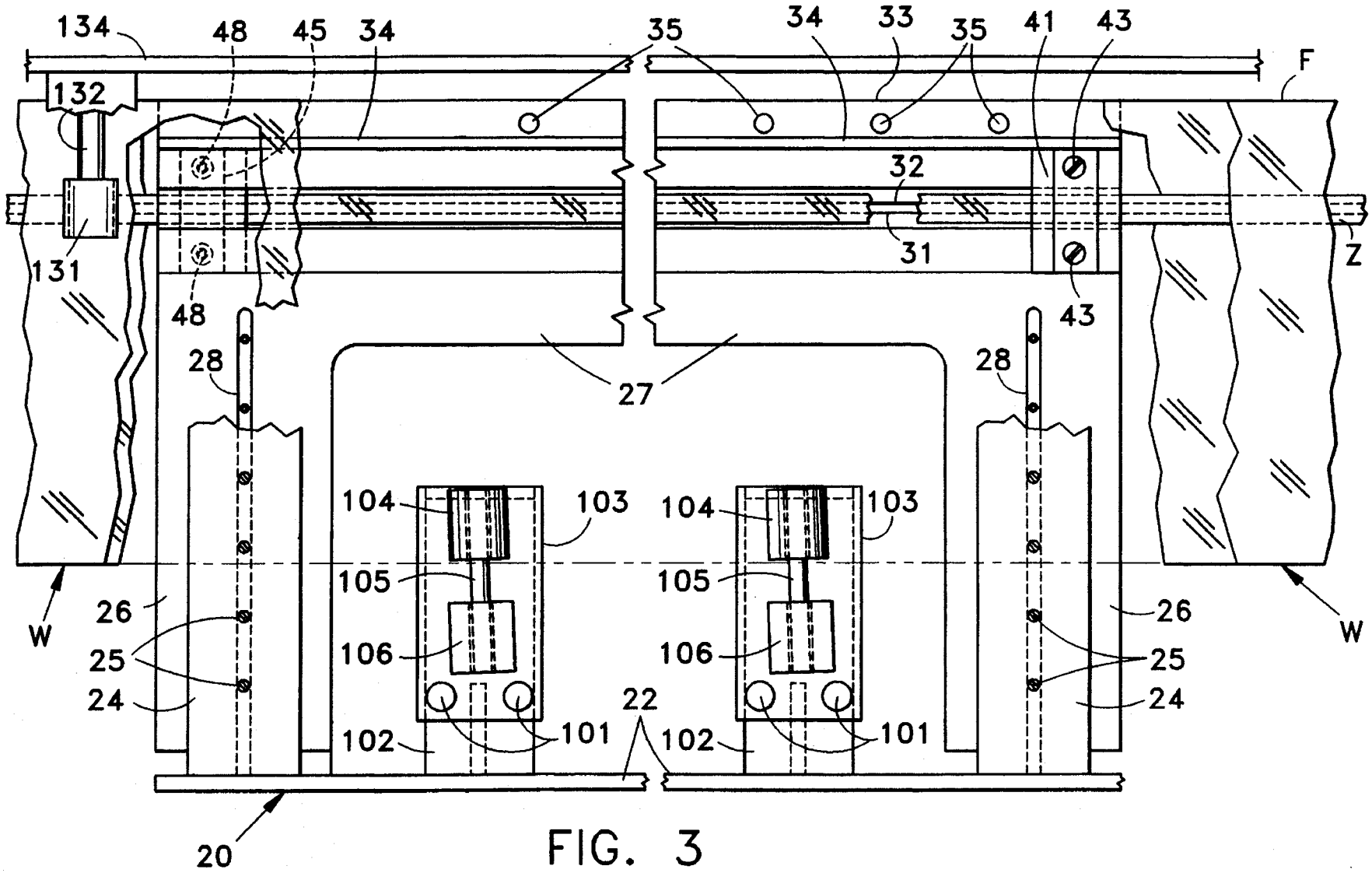
FIG. 3 is a fragmentary plan view of a portion of this machine as seen when viewed along the line 3—3 in FIG. 2 looking in the direction of the arrows.

Referring now to the drawings by numerals of reference, and first of FIGS. 1 to 4, 20 denotes generally the frame of a machine made according to one embodiment of this invention for attaching the two elements of a conventional plastic zipper Z to confronting portions of a plastic bag-making film or web W, as noted in greater detail hereinafter. Secured at one end to the front wall 22 of frame 20 and projecting horizontally rearwardly therefrom are two, longitudinally spaced support arms or brackets 24 (FIGS. 1 and 3). Adjustably secured by a plurality of screws 25 to the undersides of the arms 24 are the two, spaced, parallel, horizontally disposed legs or furcations 26 of an elongate, generally fork-shaped zipper guide plate 27. Each of the legs or furcations 26 has therethrough an elongate slot 28 (FIG. 3) for accommodating the shanks of the screws 25, so that when the screws 25 are loosened the plate 27 can be adjusted horizontally toward and away from the sidewall 22 of frame 20.

Along the straight edge of plate 27 remote from the front wall 22 of frame 20, marginal portions of the plate at opposite sides thereof are recessed or machined to form along that edge of the plate a thin, tongue-shaped rib or projection 31, which extends substantially the full length of the plate 27. The tongue-shaped projection 31 confronts upon, and is equispaced along its length from, the outer edge of a similarly shaped rib or projection 32, which is integral with and projects from one edge of an elongate, cooperating zipper guide plate 33, which is secured in spaced, coplanar relation to the guide plate 27 in a manner noted hereinafter. Plate 33 is made from an elongate strip of steel or like metal having a relatively low coefficient of heat expansion. To prevent distortion of the plate in response to extreme temperature changes, elongate stiffening ribs 34 are secured to opposite sides of plate 33 intermediate its edges, and extend longitudinally of plate 33 intermediate its ends. Moreover, even further to avoid any undesirable distortion of the zipper guide plate 33, the plate has secured in each of a plurality of longitudinally spaced openings therein a cylindrically shaped plug 35 made from a metal having a high coefficient of a heat expansion, such as for example aluminum.

Figure 4:
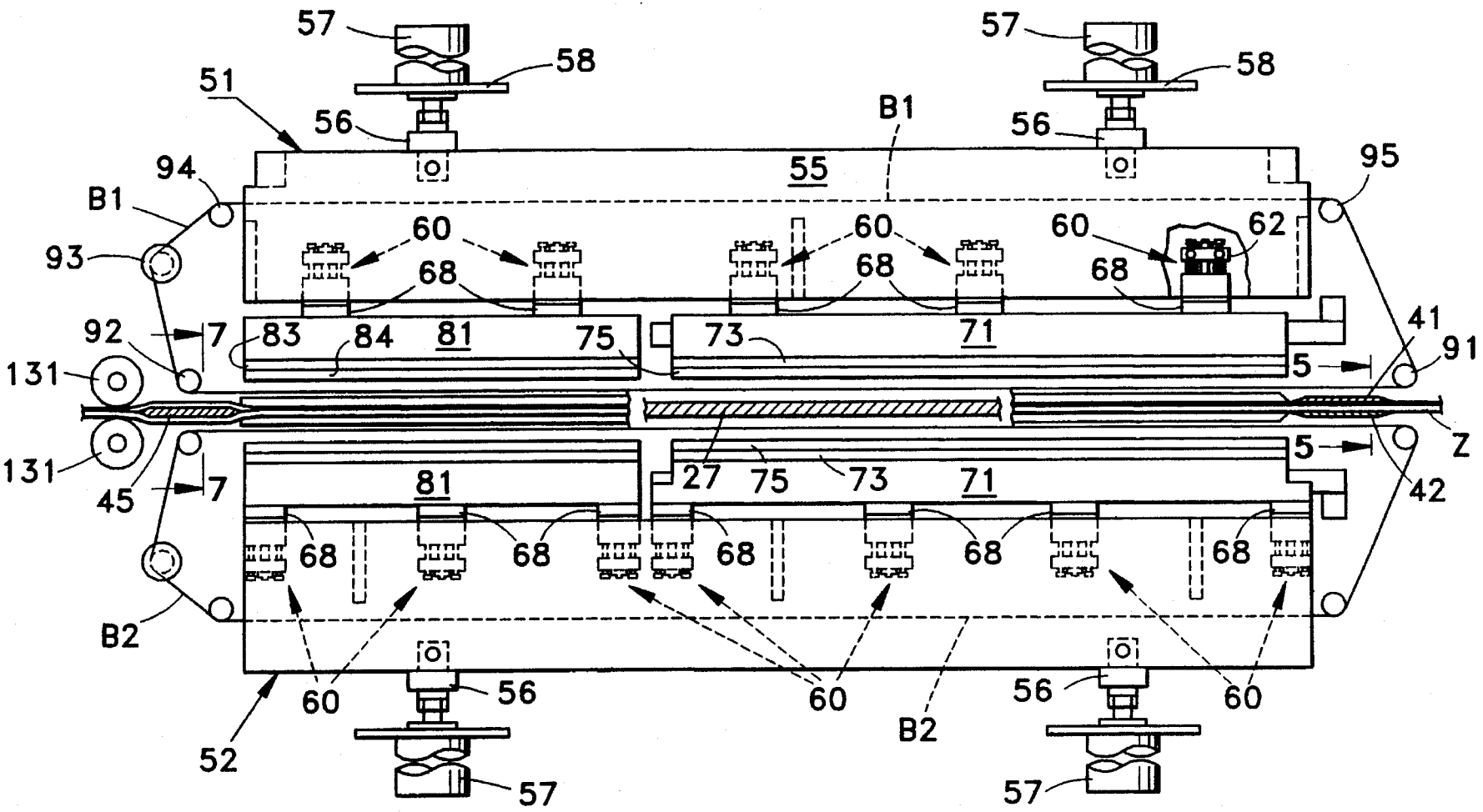
FIG. 4 is a fragmentary sectional view on a somewhat schematic and smaller scale taken along the line 4—4 in FIG. 2 looking in the direction of the arrows.
Figure 5:
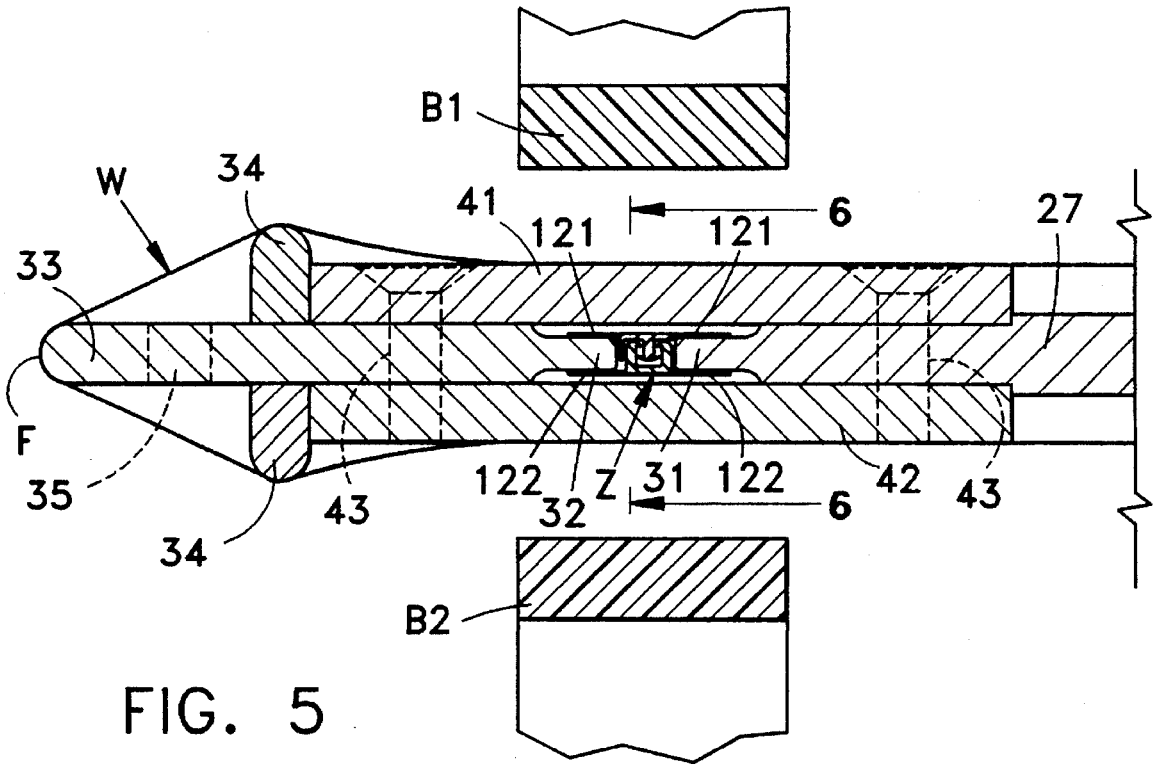
FIG. 5 is an enlarged, fragmentary sectional view taken generally along the line 5—5 in FIG. 4 looking in the direction of the arrows.
Figure 6:
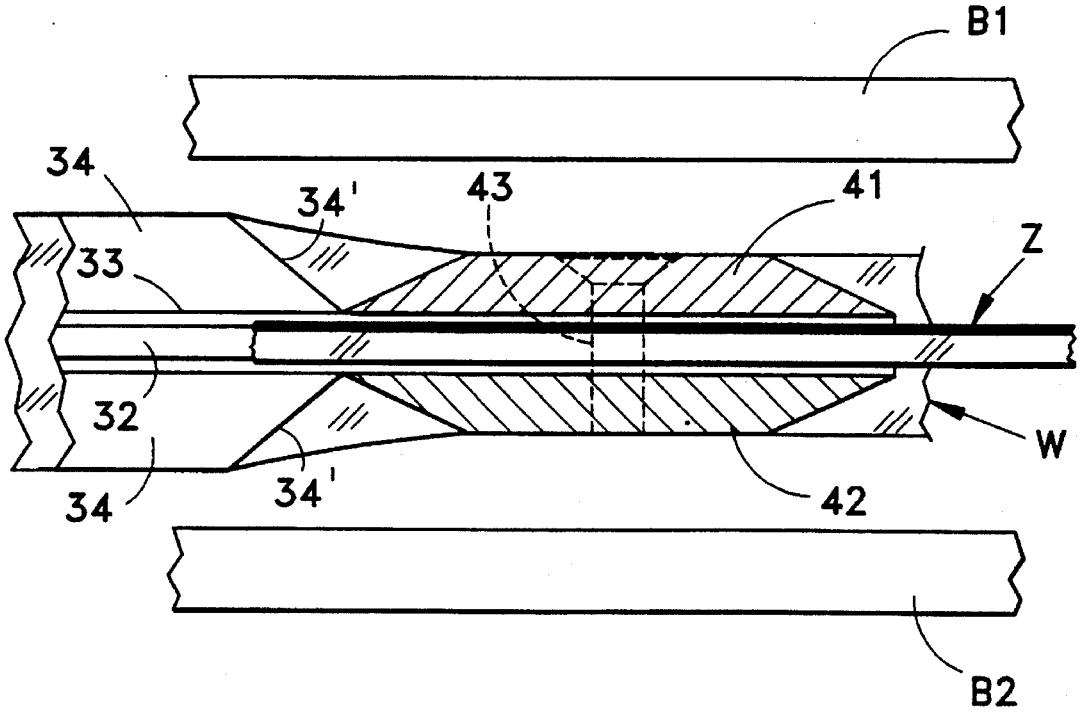
FIG. 6 is a sectional view taken generally along the line 6—6 in FIG. 5 looking in the direction of the arrows.
Figure 7:
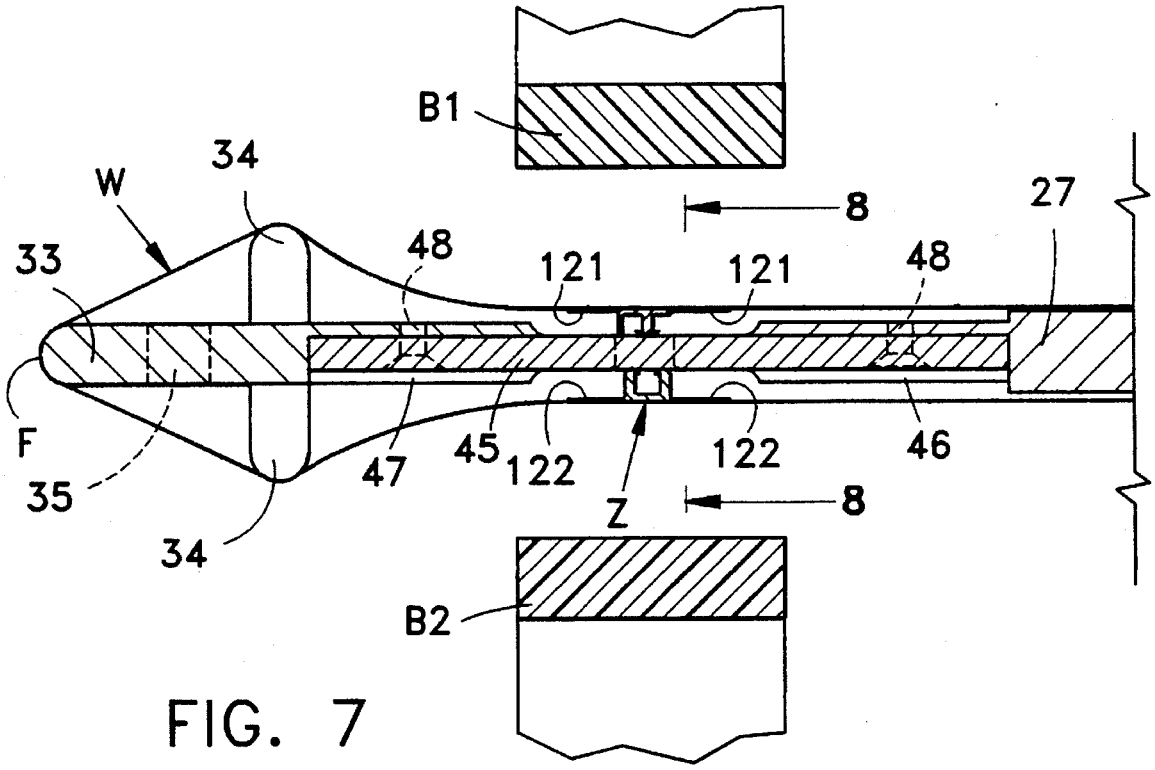
FIG. 7 is an enlarged, fragmentary sectional view taken generally along the line 7—7 in FIG. 4 looking in the direction of the arrows.

At the inlet end of the machine (the right end as shown in FIGS. 1, 3 and 4) the zipper guide plate 33 is secured to the confronting edge of the guide plate 27 by two, relatively small metal plates 41 and 42 (FIG. 5). Plates 41 and 42 extend transversely between and overlie the upper and lower surfaces, respectively, of the guide plates 27 and 33, and are secured at opposite ends thereof to those plates by screws 43. Also as shown more clearly in FIG. 5, opposed surfaces of the confronting rib or lip sections 31 and 32 on plates 27 and 33, respectively, are spaced slightly from the confronting surfaces of the connector plates 41 and 42, thereby leaving narrow spaces for accommodating marginal flange portions of the zipper elements as noted hereinafter. Also, as shown in FIG. 6, at the inlet end of the machine the adjacent ends of the reenforcing ribs 34 on the plate 33 are provided with inclined, ramp sections 34' for reasons noted hereinafter.

Figure 8:
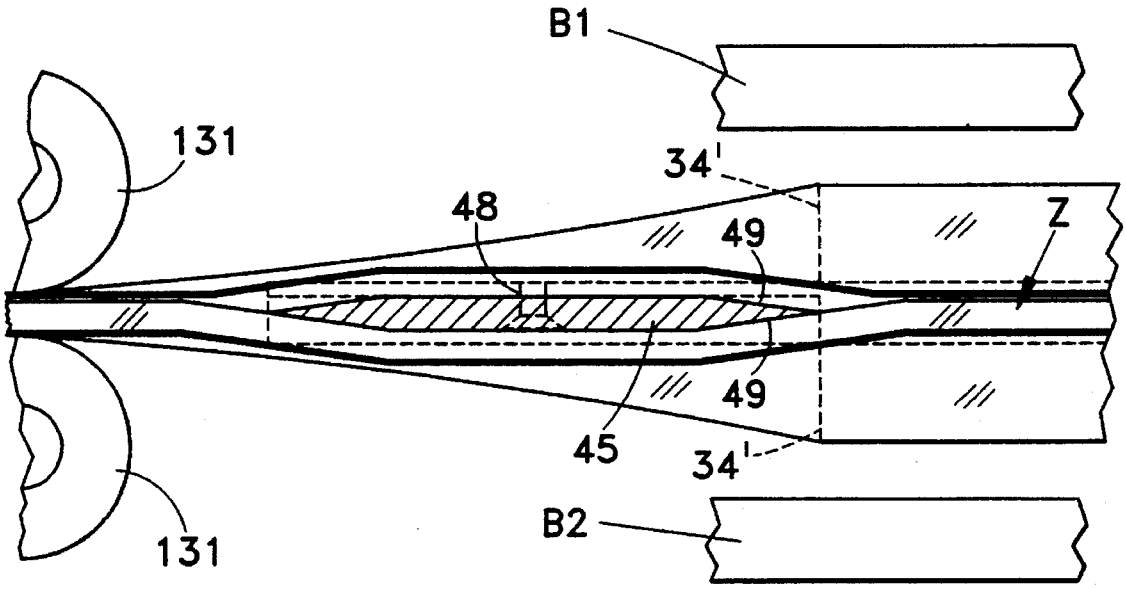
FIG. 8 is a fragmentary sectional view taken generally along the line 8—8 in FIG. 7 looking in the direction of the arrows.

At the outlet end of the machine remote from the connector plates 41 and 42 the zipper guide plates 27 and 33 are connected to one another by a single connector plate 45 (FIGS. 3, 4, 7 and 8), which is seated at opposite ends thereof in notches or recesses 46 and 47 formed in the undesides of the confronting edges of guide plates 27 and 33, respectively, and which is secured to those plates by screws 48. Connector plate 45 thus extends transversely between, and substantially medially of the opposed surfaces of plates 27 and 33, whereby the mid portion of plate 45 extends completely across the space formed between the confronting lip sections or ribs 31 and 32 of the guide plates. Moreover, as shown more clearly in FIG. 8, at least the edge of the connecting plate 45 which faces the inlet end of the machine (the right edge as shown in FIG. 8) is beveled at opposite sides thereof as at 49, whereby the tapered or beveled surfaces 49 are utilized, as noted hereinafter, for separating the two elements of the zipper Z after the elements have been fused or secured to the two confronting portions or sections of the bag-making film as noted hereinafter.

Referring again to FIGS. 1, 2 and 4, the zipper guide plates 27 and 33 are supported on frame 20 so that the space between their respective lip or rib sections 31 and 32 extends between and registers with upper and lower zipper attaching jaws which in the drawings are denoted generally by the numerals 51 and 52, respectively. Upper jaw 51 comprises a pair of spaced, parallel, metal stiffener plates 54 and 55, which are secured in spaced, parallel relation to each other by conventional means. At their upper edges plates 54 and 55 are secured to a pair of longitudinally spaced mounting blocks 56 which are fastened to the lower ends of the piston rods of a pair of air cylinders 57.As shown in FIG. 1, the air cylinders 57 are seated at their lower ends on horizontal plates 58, which are affixed to frame 20 by brackets 59. Cylinders 57 thus are mounted on frame 20 so that their pistons reciprocate about spaced, vertical axes which line a common vertical plane that extends centrally through the space between guide plates 27 and 33.

Secured between the stiffening plates 54 and 55 adjacent the lower edges thereof is a plurality of longitudinally spaced spring block assemblies, each of which is denoted generally by the numeral 60 in FIG. 4. Each such spring block assembly comprises a mounting block 62 (FIGS. 2 and 4), which is fixed between the stiffener plates 54 and 55, and a spring holder or housing 63, which is connected to and slidable beneath its associated block 62 in the space between plates 54 and 55. Each housing 63 has at its lower end an integral, rectangularly shaped flange section 64 which is positioned beneath and overlies the lower edges of plates 54 and 55, and has seated in a recess in its upper end one end of a compression spring 65, the opposite end of which is engaged with the underside of the associated mounting block 62. Each spring 65 thus tends to urge its associated spring holder 63, and hence its flange section 64, resiliently downwardly away from its mounting block 62. However, each spring holder 63 is mounted for limited axial movement toward and away from its mounting block 62 in conventional manner which is not illustrated in detail herein. Suffice it to say that the spring 65 of each block 60 urges its holder 63 downwardly to a limit position in which the flange 64 is spaced slightly beneath the lower edges of the plates 54 and 55, so that any upward stress applied to the underside of the holder 63 will be absorbed by the compression spring 65. Also in a manner which will be apparent to one skilled in the art, adjusting screws 66 may be threaded through the mounting blocks 62 in order selectively to increase or decrease the preset compression of the springs 65. Finally, a rectangular insulating block 68 is fastened to the underside of each spring holder 63 to minimize the transfer of heat to the spring blocks 60 and the associated stiffener plates 54 and 55.

As shown more clearly in FIGS. 1 and 4, the upper jaw 51 contains five, longitudinally spaced spring block assemblies 60, and the plane undersides or surfaces of their associated insulator blocks 68 lie in a common, horizontal plane. Secured at its upper surface to the undersides of the first three insulator blocks 68 located adjacent the inlet end of the machine is an elongate heater housing 71 (FIGS. 1, 2 and 4), which is generally rectangular in cross-section. Housing 71 has therethrough an axial opening or bore 72 (FIG. 2) for accommodating in a conventional manner a heater element of any conventional design, for example a resistance wire heating element. Secured to the underside of a heater housing 71 and extending longitudinally between opposite ends thereof is a sealing die 73, which has projecting centrally from the underside thereof an integral, heat sealing rib 75, the lower surface of which registers with and is only slightly wider than, the space separating the ribs 31 and 32 of the guide plates 27 and 33, respectively.

Secured to the undersides of the remaining two insulator blocks 68, which are located adjacent the outlet end of the machine frame 20, and with its inner end (its right end in FIG. 1) disposed in spaced, confronting relation to the inner end (the left end in FIG. 1) of the heater housing 71, is a coolant housing 81, which like housing 71, is generally rectangular in cross-section. Also like housing 71, housing 81 has therethrough a longitudinally extending opening or bore (not illustrated) for accommodating a cooling liquid or refrigerant, and has fastened to the lower surface thereof a cooling die 83 which has a cooling rib 84 projecting centrally from the lower surface thereof, and which is aligned longitudinally with the heat sealing rib 75 on the heating die 73.

With but one or two exceptions noted hereinafter, the lower jaw 52 is substantially identical in construction to the upper jaw 51, and for that reason the lower jaw will not be described in detail herein. Moreover, for purposes of simplification, those elements in the lower jaw 52 which are similar to those in the upper jaw 51 have been denoted by the same numerals as employed in connection with the upper jaw. With that understanding, attention is directed to FIG. 4, wherein it will be noted that the lower jaw has secured between its stiffener plates 54 and 55 seven spring block assemblies 60, rather than the five employed in the upper jaw 51. Four of the seven spring block assemblies 60 in the lower jaw 52 have their insulator blocks 68 secured to the underside of a heater housing 71, which, except for the manner in which it is supported on its associated stiffener plates 54 and 55, is similar to the heater housing and attached heater die 73 as employed in the upper jaw. Notably, however, the four spring block assemblies 60 which support thereon the lower heater housing 71 are longitudinally offset from the three spring block assemblies 60 to which the upper heater housing 71 is attached. The remaining three of the seven spring block assemblies in the lower jaw 52 have their insulator plates 68 secured to the underside a coolant housing 81, which is also similar in configuration to the housing 81 on the upper jaw 51. However, again, the three spring block assemblies 60, upon which the lower coolant housing 81 is supported, also are longitudinally offset from the two spring block assemblies 60 which are attached to the upper coolant housing 81. Thus, all of the spring block assemblies 60 in the lower jaw are offset from and do not register vertically with, any of the five spring block assemblies 60 carried by the upper jaw 51.

During the operation of the machine there will be intervals during which the upper and lower jaws 51 and 52 are urged toward each other, and tend resiliently to engage the plastic, bag-making film or web W. At such time the hot heat sealing ribs 75 carried by the upper and lower heater housings 71, will tend to melt and otherwise fuse and become attached to the bag-making film unless some precaution is taken. For this reason, two, TEFLON-containing belts B1 and B2 are mounted, as shown for example in FIG. 4, to travel in endless paths about their respective jaws 51 and 52, respectively. For example, the upper belt B1 is mounted to travel horizontally beneath and parallel to the lower end of jaw 51 about a pair of guide rollers 91 and 92 which are mounted on frame 20 for rotation about spaced, parallel axes adjacent opposite ends or jaw 51. After passing around a flanged guide roller 93, which is mounted to rotate on the frame adjacent the discharge end of the machine (the left end of jaw 51 as shown in FIG. 4), belt B1 is guided by a set of upper guide rollers 94 and 95 adjacent opposite ends of the upper jaw in such manner that belt B1 travels horizontally in the space between the upper stiffener plates 54 and 55 above the upper ends of the spring block assemblies 60 in jaw 51.

The lower belt B2 is mounted in a similar manner so that one upper or inner run thereof travels horizontally and longitudinally across the inner or upper end of jaw 52, and then travels in the space between the stiffener plates 54 and 55 of lower jaw 52, and beneath the spring block assemblies 60 carried by the lower jaw. As a result, each of the belts B1 and B2 has a return run thereof which travels horizontally in the space between the stiffener plates 54 and 55 of the associated jaw.

A polyethelene film or other plastic web W which is to form the zippered bag is folded intermediate its longitudinal side edges, for example about a fold line F as shown in FIG. 1, so that two overlapping portions of the web can be fed longitudinally through the machine from the right end thereof toward the left end as shown in FIG. 1. As the web W enters the machine its folded portion or fold line F slides along the outer or left hand edge of the guide plate 33 as shown in FIGS. 2, 6 and 8, and the overlapping portions of the web W extend over the upper and lower surfaces, respectively, of the stiffener bars 34, across the space between the zipper guide plates 27 and 33, and beneath opposite sides of the guide plate 27 toward the front wall 22 of the frame. Mounted for limited adjustment by screws 101 on a pair of spaced brackets 102 which project from the inside surface of the frame wall 22 into the space between the legs 26 of guide plate 27 are two, spaced, web guide plates 103. Mounted on each of the upper and lower surfaces, respectively, of each plate 103 is a web guiding roller 104 having a shaft 105 that is rotatably mounted in a roller support 106, which is mounted on the same side of plate 103. Each of the plates 103, therefore, has an upper web guide roller 104, and a lower web guide 104, each of which rollers has rolling, tangential engagement with the adjacent surface of the associated plate 103. The upper and lower, folded portions of the web W pass between, respectively, the upper rolls 104 and the upper surfaces of the guide plates 103, and the lower rolls 104 and the lower surfaces of the guide plates 103. Shafts 105 of the guide rolls 104 are inclined slightly in a counterclockwise direction as shown in FIG. 3 relative to the front wall 22 of the frame, and in such manner tend to draw the upper and lower portions of the web W slightly forwardly toward the front wall of frame 22 during the passage in the web through the machine, thus causing the fold portion F of the web to be retained snugly against the outer edge of the web guide plate 33.

At the same time that the web W is drawn through the machine from the right end of frame 20 toward the left end thereof as shown in FIG. 1, a conventional, two-piece zipper Z is fed from a supply thereof around a guide roller 110 (FIG. 1) which is mounted to rotate on the inner end of a bracket arm 111. Arm 111 projects from the inside surface of the front wall 22 of the frame rearwardly toward the fold section F of the web as the latter is drawn through the machine. The periphery of the guide roll 110 registers tangentially with the centerline of the space between the zipper guide surfaces 31 and 32. The zipper Z passes from the guide roller 110 into the space between the zipper guide connecting plates 41 and 42 at the entrance of the machine, and between the confronting ends of the zipper guide elements or tongues 31 and 32, as shown more clearly in FIG. 5. Also, as shown in this figure, the upper, male section of the zipper Z has projecting from opposite sides thereof integral, longitudinally extending flange portions 121 which overlie the upper surfaces of the guide tongues 31 and 32, while the lower, female section of the zipper has projecting from opposite sides thereof integral flange portions 122, which overlie the lower surfaces of the guide tongues 31 and 32. As the zipper Z enters the machine, the upper, male portion of the zipper is seated in the lower, female portion of the zipper as shown in FIG. 5, and the two sections of the zipper remain in this attached position until they exit from the machine, as described thereafter.

By apparatus, not illustrated, the web W and the zipper Z are advanced intermittently through the machine from the inlet end to the outlet end thereof, and during this advance the insulator belts B1 and B2 also travel endlessly in their respective paths. For example, when the machine is started, the web W and the zipper Z are advanced simultaneously with the folded web W passing up the ramped surfaces 34' (FIG. 6) of bars 34 and over the connector plates 41 and 42, as shown in FIG. 5, and with the closed zipper passing between the guide tongues 31 and 32, also as shown in FIG. 5. When the registering portions of the web W and the zipper Z have passed the full length of the heated sealing die 73, the upper and lower jaws are advanced toward each other urging the heated dies against the insulator belts B1 and B2, and at the same time transmitting sufficient heat through those belts to cause the upper portion of the web W to be fused or heat sealed to the flange sections 121 of the upper section of the zipper Z, and at the same time to cause the lower portion of the web W to be fused or otherwise heat sealed against the flange portions 122 of the lower section of the zipper Z. Thereafter the jaws 51 and 52 are moved away from each other and the web W and zipper Z are again advanced to place between the cooling dies 83 the previously heat sealed zipper and web sections, and at the same time to position between the heating dies 73 new sections of the zipper and web. Advance of the zipper and web are then again momentarily halted while the jaws 51 and 52 again are advanced toward each other so that the cooling dies 83 cool the materials previously fused together, while at the same time the heating dies 73 fuse together the new registering portions of the web and zipper flanges 121 and 122. In this manner the zipper Z and web W are intermittently advanced through the machine frame 20 with successive portions of the zipper being alternately fused to the overlying web sections and then being cooled between the cooling dies 83 before reaching the discharge end of the machine.

Referring now to FIGS. 1, 3, 4, 7 and 8, as the fused zipper and associated web sections reach the discharge end of the machine, the previously connected zipper sections reach the inclined portions 49 of the connector plate 45 as shown in FIG. 8. In so doing, the upper, male section of the zipper Z is separated from the lower, female section, and passes upwardly (FIG. 8) of one of the inclined surfaces 49 of the connector plate 45, while the female portion of the zipper passes downwardly over the other inclined surface 49 so that both sections of the zipper remain parted from each other during the time that the zipper Z, with the web sections now attached thereto, traverses the plate 45.

After departing or leaving the plate 45, however, the upper and lower zipper sections pass between a pair of rotating closing rolls 131, which are supported on shafts 132 that project from the rear wall 134 of the machine frame to rotate about spaced, parallel, horizontal axes. Therefore, as the bag-making material leaves the machine frame 20, the zipper Z will have been secured to overlapping sections of the bag-making web W, and the two sections of the zipper will have been opened upon passing over the connector plate 45, and then will have been reclosed by virtue of the cooperating closing rolls 131. In this manner it is assured that the zipper can be opened after it has been heat fused to registering portions of the plastic web.

From the foregoing, it will be apparent that the present invention provides a relatively simple method and means for accurately and reliably securing a plastic zipper to an associated plastic web during the manufacture of plastic bags of the type described. Moreover, while this invention has been illustrated and described in connection with only certain embodiments thereof, it will be apparent that this application is intended to cover such modifications as may fall within the scope of one skilled in the art or the appended claims.

We claim:

1. In a plastic bag making machine having thereon a pair of jaws between which two cooperating elements of a plastic zipper, and two sections of plastic web to which the zipper elements are to be attached, are disposed to be fed simultaneously through the machine from an inlet end to an outlet end thereof, a pair of spaced guide plates forming between confronting, longitudinal side edges thereof an elongate zipper guide slot extending between the inlet and outlet ends of the machine, and operative to guide said cooperating zipper elements in a predetermined path positioned between said jaws and said two sections of web during passage thereof through the machine, means mounting said jaws one above the other on said machine for reciprocation toward and away from each other, and respectively into and out of an operative position in which registering, heated portions of said jaws adjacent said inlet end of said machine urge portions of said two sections of web into engagement with registering portions of said zipper elements, thereby to fuse each of said zipper elements to a different one of said web sections, means for maintaining said two cooperating elements of said zipper releasably engaged with each other during passage thereof from said inlet to said outlet end of said machine, and means for momentarily separating said two zipper elements from each other upon passage thereof through said outlet end of said machine, one of said pair of guide plates comprising an elongate, narrow plate made from a metal having a relatively low coefficient of heat expansion, and having therethrough intermediate its ends a plurality of longitudinally spaced openings in each of which is secured a plug made from a metal having a relatively high coefficient of heat expansion, thereby to minimize any undesirable distortion of said one plate in response to extreme changes in the temperature thereof.

2. In a machine as described in claim 1, wherein said one guide plate has an elongate, metal stiffening rib secured to and projecting from at least one surface thereof adjacent said space openings, and extending longitudinally of said one plate adjacent one longitudinal side edge thereof.

3. In a machine as defined in claim 1, wherein said plugs are made from aluminum.

4. In a machine as defined in claim 1, including means connecting one of said one guide plates adjacent opposite ends thereof to the other of said guide plates of said pair, thereby to maintain said confronting edges of said plates in spaced, parallel relation to each other, said connecting means comprising a first pair of spaced connector plates secured to and extending over said guide plates transversely of said guide slot adjacent said inlet end of the machine, and defining therebetween a narrow space through which said cooperating elements of said zipper pass upon entering said machine, and a third connector plate secured at opposite ends thereof to said guide plates adjacent said outlet end of said machine, said means for separating said zipper elements comprising intersecting tapered surfaces formed on one edge said third plate and extending transversely of said guide slot and substantially medially thereof, thereby to effect disengagement of said two zipper elements from each other upon passage thereof from the outlet end of said machine.

5. In a machine as defined in claim 4, including a pair of zipper closing rollers mounted in said machine for rotation about spaced, parallel axes adjacent said third connector plate, and forming therebetween a nip registering with said third connector plate and operative to urge said zipper elements back into engagement with each other after they pass over said third connector plate.

6. In a machine as defined in claim 1, wherein one of said guide plates has formed along a further, longitudinal side edge thereof remote from said guide slot a web guiding surface which extends longitudinally of the machine between its inlet and outlet ends, said web is disposed to be folded over and to be slidingly guided along said web guiding surface during passage of the web through the machine, and with said two sections of said web extending between said jaws and over upper and lower surfaces, respectively, of said guide plates, and web tensioning means is mounted on said machine adjacent the other of said guide plates and is disposed to engage and to draw said two sections of said web in a direction to maintain said web snugly against said web guiding surface on said one guide plate.

7. In a machine as defined in claim 1, wherein said heated portions of said jaws comprise a pair of elongate, heating bars mounted on said jaws in vertically spaced confronting relation to each other and to a first portion of said guide slot adjacent said inlet end of the machine, and each of said jaws has one of two elongate cooling bars mounted thereon adjacent to, and in longitudinal alignment with, its associated heating bar, said cooling bars being disposed in vertically spaced confronting relation to each other and to a second portion of said guide slot adjacent said outlet end of the machine.

8. In a machine as defined in claim 7, wherein each of said jaws has therethrough above and in registry with its associated heating and cooling bars an elongate passageway opposite ends of which open on the machine adjacent its inlet and outlet ends, respectively, and each of said jaws has one of two endless belts mounted thereon for travel in an endless path from adjacent one end of the machine to the other, and with one longitudinal run of a respective belt extending through said passageway in its associated jaw, and with a second longitudinal run extending between one of said two sections of said web and the heating and cooling bars of said associated jaw.

9. In a machine as defined in claim 8, wherein each of said belts includes a polytetrafluorethylene material which prevents fusion of said two sections of said web to said heating bars of said jaws.

10. In a machine as defined in claim 7, wherein each of said jaws has thereon a plurality of spaced bar supporting blocks, which are secured at one side to the heating and cooling bars of the associated jaw at longitudinally spaced locations therealong, and which are resiliently connected at their opposite sides to the associated jaw thereby to support its associated heating and cooling bars for limited movement relative thereto transversely of said guide slot, and the spaced bar supporting blocks of one of said jaws are slightly offset longitudinally with respect to the bar supporting blocks of the other jaw.

11. In a machine as defined in claim 10, including compression spring means interposed between each of said blocks and its associated jaw, and operative to resist movement of the associated heating and cooling bars toward said associated jaw, and means for adjusting said compression spring means to alter the resistance exerted thereby against the movement of the associated heating and cooling toward said associated jaw.

12. In a plastic bag making machine having thereon a pair of jaws between which two cooperating elements of a plastic zipper, and two sections of plastic web to which the zipper elements are to be attached, are disposed to be fed simultaneously through the machine from an inlet end to an outlet end thereof, a pair of spaced guide plates forming between confronting, longitudinal side edges thereof an elongate zipper guide slot extending between the inlet and outlet ends of the machine, and operative to guide said cooperating zipper elements in a predetermined path positioned between said jaws and said two sections of web during passage thereof through the machine, means mounting said jaws one above the other on said machine for reciprocation toward and away from each other, and respectively into and out of an operative position in which registering heated portions of said jaws adjacent said inlet end of said machine urge portions of said two sections of web into engagement with registering portions of said zipper elements, thereby to fuse each of said zipper elements to a different one of said web sections, means for maintaining said two cooperating elements of said zipper releasably engaged with each other during passage thereof from said inlet to said outlet end of said machine, and means for momentarily separating said two zipper elements from each other upon passage thereof through said outlet end of said machine, one of said guides plates having formed along a further, longitudinal side edge thereof remote from said guide slot a web guiding surface which extends longitudinally of the machine between its inlet and outlet ends, said web being disposed to be folded over and to be slidingly guided along said web guiding surface during passage of the web through the machine, and with said two sections of said web extending between said jaws and over upper and lower surfaces, respectively, of said guide plates, and web tensioning means mounted on said machine adjacent the other of said guide plates and disposed to engage and to draw said two sections of said web in a direction to maintain said web snugly against said web guiding surface on said one guide plate, said web tensioning means comprising a plurality of rollers mounted on said machine for rotation about spaced, parallel axes inclined at slightly less than right angles to said guide slot, and each disposed to have rolling engagement with one of said two sections of said web.

* * * * *